US009774956B2

(12) United States Patent
Mao et al.

(10) Patent No.: US 9,774,956 B2
(45) Date of Patent: Sep. 26, 2017

(54) SPEAKER

(71) Applicants: Lubin Mao, Shenzhen (CN); Hongxing Wang, Shenzhen (CN)

(72) Inventors: Lubin Mao, Shenzhen (CN); Hongxing Wang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/061,261

(22) Filed: Mar. 4, 2016

(65) Prior Publication Data

US 2017/0034629 A1 Feb. 2, 2017

(30) Foreign Application Priority Data

Jul. 31, 2015 (CN) ..... 2015 2 0572364 U

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 9/04*** | (2006.01) |
| ***H04R 9/02*** | (2006.01) |
| *H04R 1/06* | (2006.01) |

(52) U.S. Cl.

CPC ..... *H04R 9/045* (2013.01); *H04R 9/025* (2013.01); *H04R 1/06* (2013.01); *H04R 2499/11* (2013.01)

(58) Field of Classification Search

CPC ..... H04R 9/045; H04R 1/06; H04R 7/127; H04R 7/14; H04R 9/025; H04R 9/06; H04R 2499/11

USPC ..... 381/409

See application file for complete search history.

(56) References Cited

U.S. PATENT DOCUMENTS

| | | | | | |
|---|---|---|---|---|---|
| 5,701,358 | A * | 12/1997 | Larsen | H04R 9/063 | 381/400 |
| 2005/0276431 | A1* | 12/2005 | Moore | H04R 1/345 | 381/340 |
| 2010/0171376 | A1* | 7/2010 | Huang | H02K 33/18 | 310/25 |
| 2012/0177246 | A1* | 7/2012 | Shi | H01F 7/0289 | 381/398 |
| 2016/0157019 | A1* | 6/2016 | Tomas | H04R 9/025 | 381/400 |

* cited by examiner

*Primary Examiner* — Sean H Nguyen
(74) *Attorney, Agent, or Firm* — Na Xu; IPro, PLLC

(57) ABSTRACT

A speaker is provided in the present disclosure. The speaker includes a shell, a magnetic system received in the shell for forming a magnetic gap, and a vibrating system. The vibrating system includes a membrane, a coil assembly for driving the membrane to vibrate. The coil assembly includes a coil arranged in the magnetic gap and a coil support for supporting the coil; the coil includes at least one lead wire. The vibrating system further includes a supporting assembly and a conductive module arranged on the supporting assembly, the coil support is connected between the membrane and the supporting assembly, and the at least one lead wire of the coil is connected to the conductive module on the supporting assembly.

14 Claims, 5 Drawing Sheets

SPEAKER

FIELD OF THE DISCLOSURE

The present disclosure relates to electro-acoustic converting technologies, and more particularly, to a speaker for producing audible sound.

BACKGROUND

Speakers are widely applied in mobile devices, such as mobile phones, tablet computers, laptop computers, portable game player, portable multimedia devices, or the like, for converting electrical signals into audible sounds. A related speaker includes a vibration system, a magnetic system, and a holder for holding the vibration system and the magnetic system.

The vibrating system includes a membrane and a coil assembly connected to the membrane, the coil assembly includes a coil located in the magnetic gap provided by the magnetic system. In operation, the coil receives an electric signal and drives the membrane to vibrate and produce sound. In order to receive the electric signal, the coil generally includes a lead wire fixed to a solder pad on the holder by welding.

In the above-described speaker, when the membrane is driven to vibrate with great vibration amplitude, because the lead wire of the coil is fixed to the holder, the vibration of the membrane may be retarded by the coil. This may cause the membrane to suffer undesired shaking, and correspondingly sound distortion. Therefore, an acoustic performance of the speaker is low. Moreover, the membrane may be impaired when the shaking of the membrane is too strong, and thus a reliability of the speaker is also low.

Therefore, it is desired to provide a new speaker which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
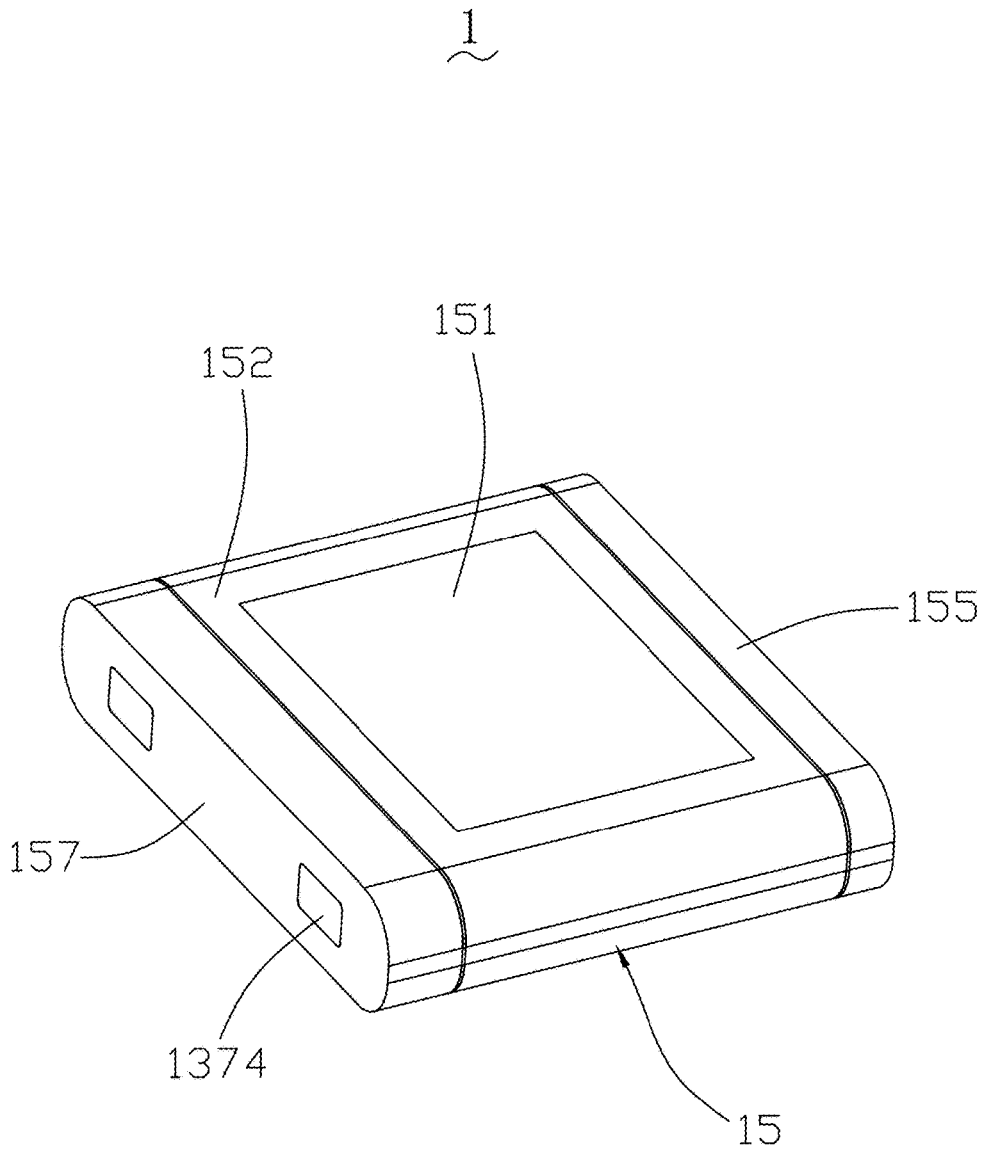
FIG. 1 is an assembled view of a speaker according to an embodiment of the present disclosure.
Figure 2:
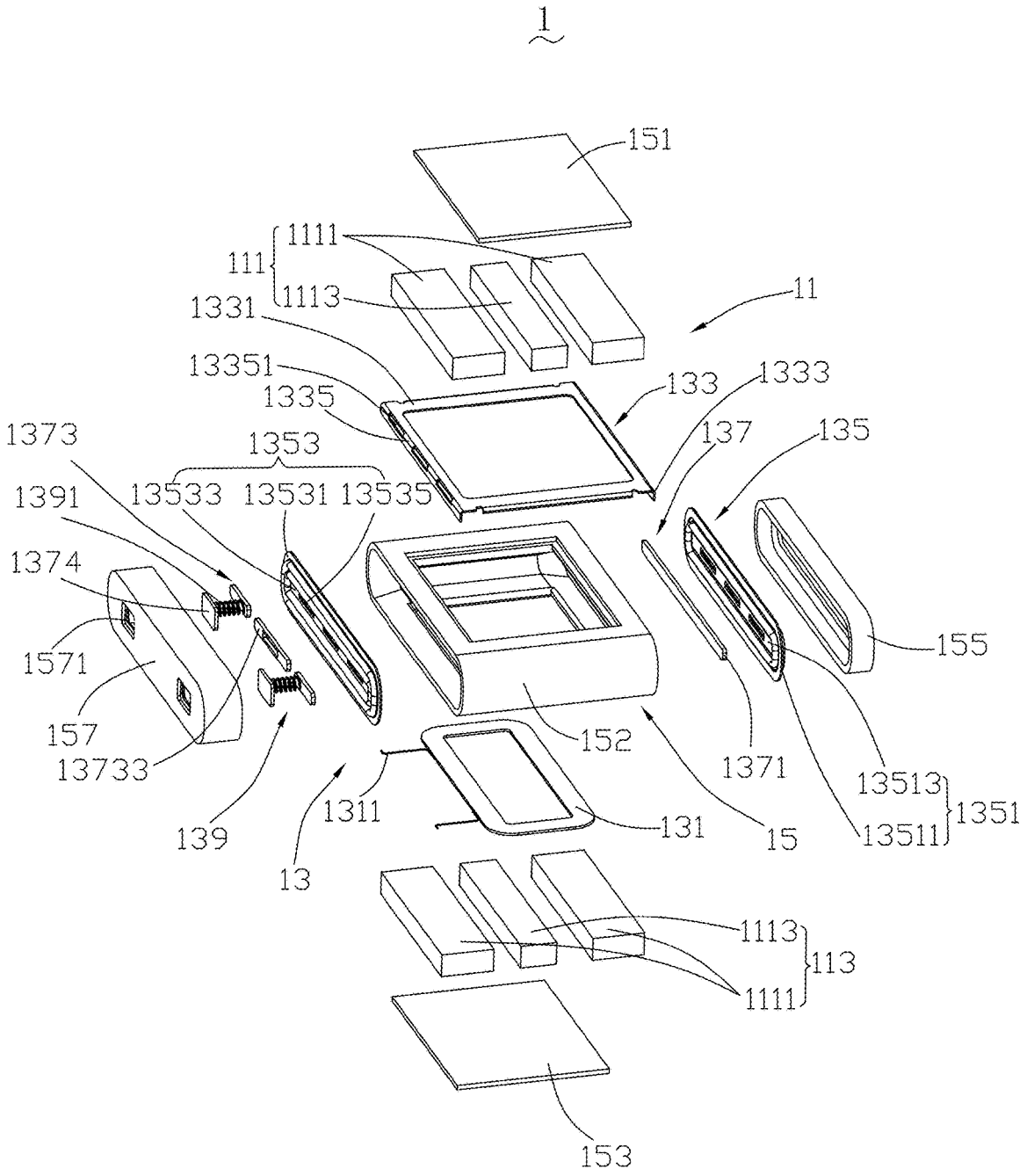
FIG. 2 is an exploded view of the speaker of FIG. 1.
Figure 3:
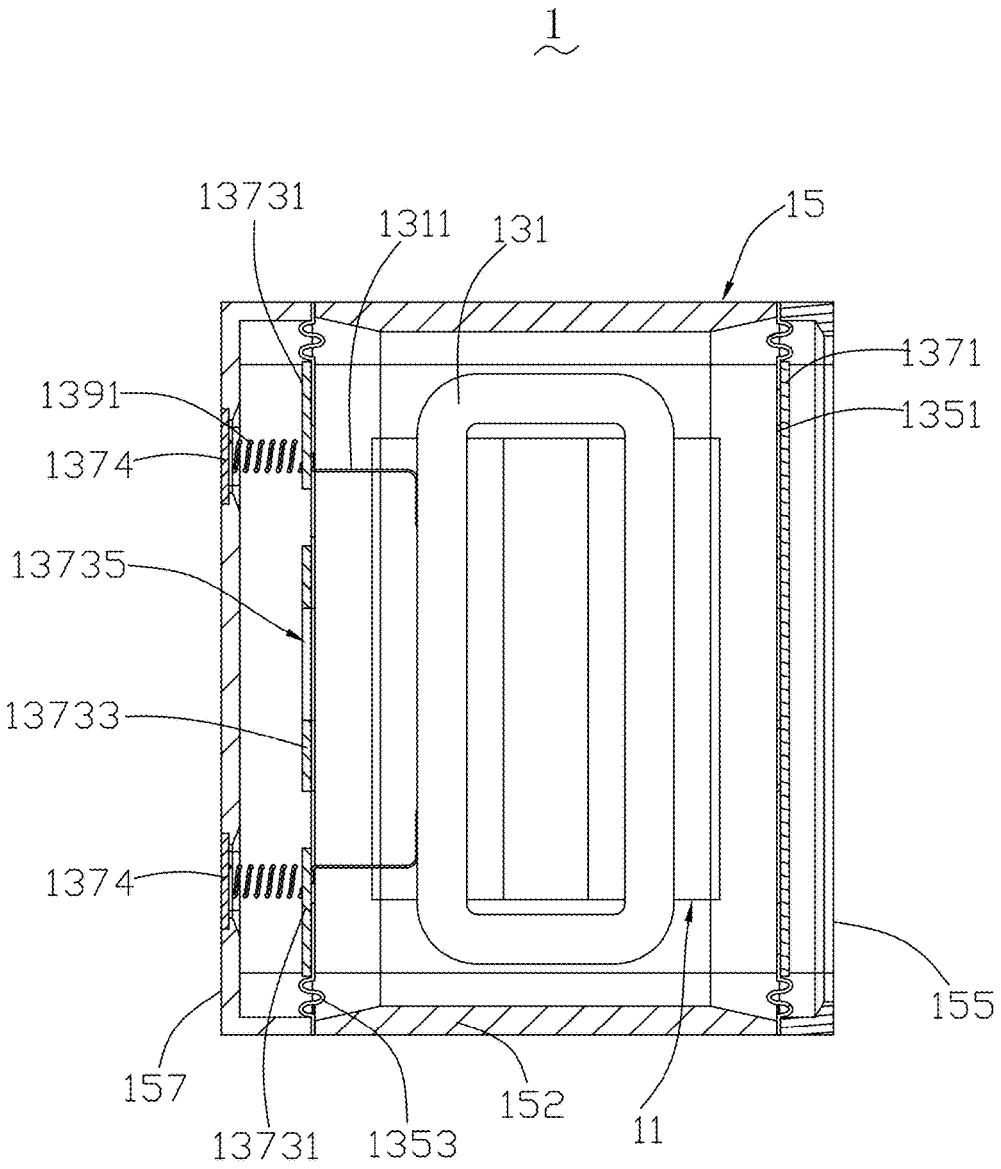
FIG. 3 is a planar view of the speaker of FIG. 1.

Referring to FIGS. 1-3, a speaker 1 according to an embodiment of the present disclosure is shown. The speaker 1 includes a magnetic system 11, a vibrating system 13 and a shell 15. The vibrating system 13 and the magnetic system 11 are accommodated in the shell 15.

Specifically, the shell 15 includes a main frame 152, a first cover plate 151, a second cover plate 153, a front cover 155 and a rear cover 157. The main frame 152 provides a receiving cavity for receiving the vibrating system 13 and the magnetic system 11, and may be a hollow frame with two opposite openings. In the present embodiment, the two openings are aligned along a vibration direction of the vibrating system 13, and are defined as a front opening located at a front end of the main frame 152, and a rear opening located at a rear end of the main frame 152. The front cover 155 is engaged with the front end of the main frame 152; the rear cover 157 is engaged with the rear end of the main frame 152. In particular, at least one of the front cover 155 and the rear cover 157 may include a sound outlet for outputting audible sound generated by the speaker 1, and in the present embodiment, the sound outlet is formed at in the front cover 155 and faces the first opening of the main frame 152.

The main frame 152 further includes a top opening and a bottom opening respectively from at a top plate and a bottom plate thereof; the top plate and the bottom plate are opposite to each other and perpendicular to the vibration direction of the vibrating system 13. The first cover plate 151 and the second cover plate 153 serves respectively as a top cover plate and a bottom cover plate, and are provided to cover the top opening and the bottom opening of the main frame 152. In the present embodiment, the first cover plate 151 and the second cover plate 153 are detachable from the main frame 152, which is convenient for assembly and disassembly of speaker components, including the vibrating system 13 and the magnetic system 15, inside the shell 11.

The magnetic system 11 includes a first magnet module 111 and a second magnet module 113 opposite to and apart from each other to form a magnetic gap. In the present embodiment, the magnetic system 11 merely arranged at two opposite sides of a vibration driving module of the vibrating system 13, and no magnetic element is provided in the vibration driving module of the vibrating system 13.

The first magnet module 111 includes two main magnets 1111 parallel to each other, and a secondary magnet 1113 arranged between the two main magnets 1111. The secondary magnet 1113 is parallel to the two main magnets 1111, and abuts against the two main magnets 1111 to form a one-piece magnet module. The second magnet module 113 is opposite to the first magnet module 111 and has a configuration substantially same as the first magnet module 111; that is, the second magnet module 113 also includes two main magnets 1111 with opposite magnetized directions, and a secondary magnet 1113 arranged between the two main magnets 1111.

The two main magnets 1111 of the first magnet module 111 are respectively parallel to and aligned with the two main magnets 1111 of the second magnet module 111 to form the magnetic gap, and the secondary magnet 1113 of the first magnet module 111 is also parallel to and aligned with the secondary magnet 1113 of the second magnet module 113.

In the present embodiment, each of the two main magnets 1111 has a magnetized direction perpendicular to the vibration direction of the vibrating system 13, and magnetized directions of the two main magnets 1111 are opposite to each other. Moreover, a magnetized direction of the secondary magnet 1113 is perpendicular to the magnetized directions of the two main magnets 1111, that is, parallel to the vibration direction of the vibrating system 13. With this configuration, an electromagnetic conversion efficiency of the magnetic system 11 can be increased to ensure the speaker 1 to have a better sound effect.

It should be noted that the above description is merely one of multiple optional configurations of the magnetic system 11; in other embodiments, the magnetic system 11 can be modified as necessary. For example, the first magnet module 111 may be a single main magnet, and the second magnet module 113 may be removed or replaced by a magnetic-conductive component; alternatively, each of the first magnet module 111 and the second magnet module 113 may merely include a single main magnet.

The vibrating system 13 includes a coil 131, a coil support 133, a membrane module 135, a supporting assembly 1353, a dome module 137 and a conductive module 139. The membrane module 135 includes a membrane 1351 arranged at the front opening of the main frame 152. The supporting assembly 1353 may also be in a membrane configuration which is arranged at the rear opening of the main frame 152 and opposite to the membrane 1351. The dome module 137 includes a front dome 1371 attached on a front surface of the membrane 1351 and facing the front cover 155, and the rear dome 1373 attached on a rear surface of the supporting assembly 1353 and facing the rear cover 157. The conductive module 139 is arranged on the rear dome 1373 or the supporting assembly 1353, and is electrically connected to an external circuit.

The coil 131 and the coil support 133 cooperatively form a coil assembly received in the main frame 152, which serves as the vibration driving module for driving the membrane module 135 to vibrate and produce audible sound. The coil assembly is located in the magnetic gap provided by the magnetic system 11, and is connected between the membrane 135 and the supporting assembly 1353. Moreover, the coil assembly is arranged in a plane perpendicular to the vibration direction of the membrane module 135.

Figure 4:
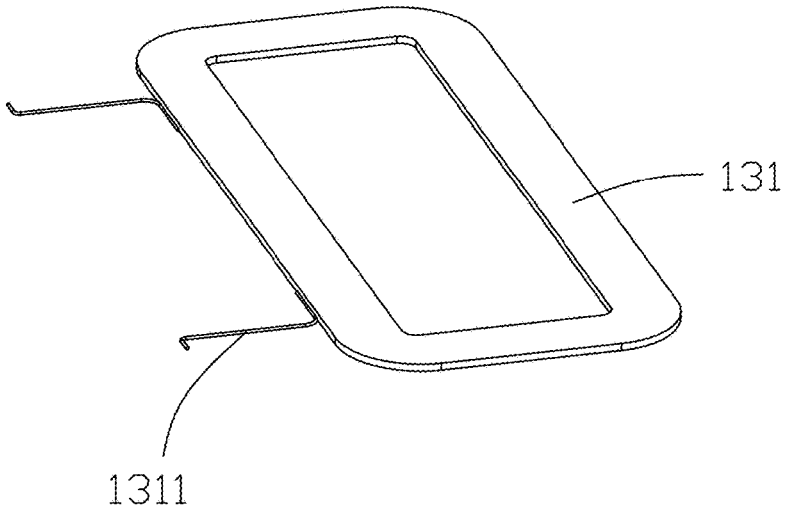
FIG. 4 is a schematic view of a coil of the speaker of FIG. 1.
Figure 5:
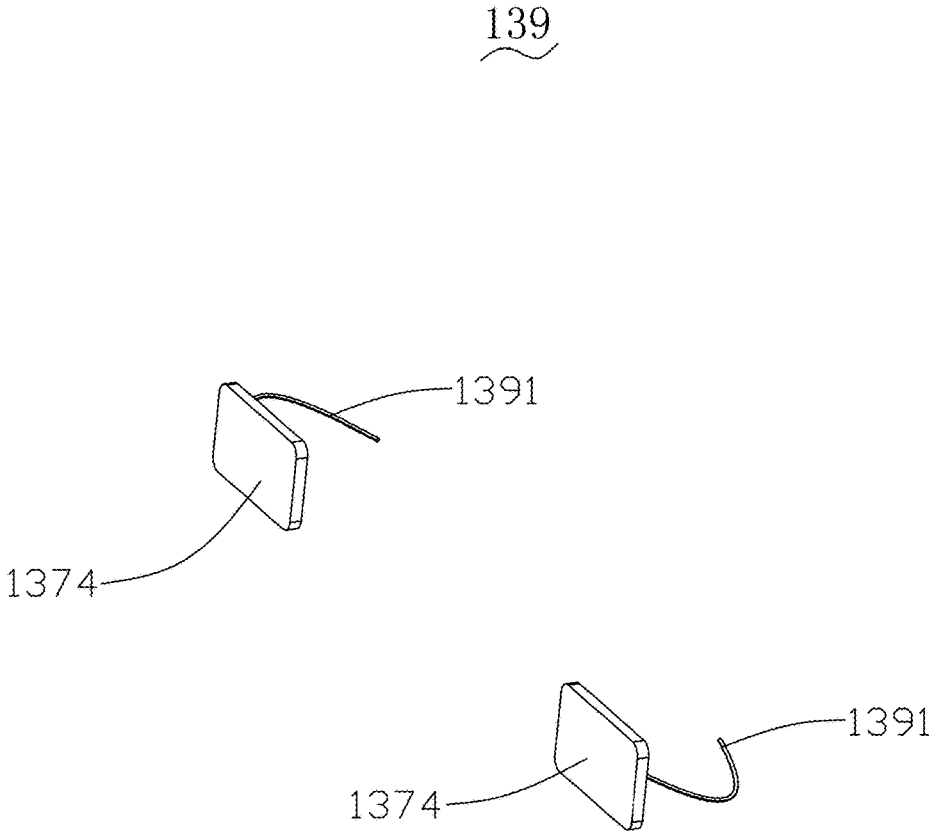
FIG. 5 is a schematic view of an alternative conductive module applicable to the speaker of FIG. 2.

Referring also to FIG. 4, the coil 131 may be an oblate ring-shaped coil formed by a plurality of conductive wires, and is positioned in the magnetic gap of the magnetic system 11 to obtain a long stroke. The coil 131 may includes two coil units and a pair of lead wires 1311 led out from the two coil units respectively, each of the lead wires 1311 has a free end extending towards and fixed to the supporting assembly 1353, and moreover, the free end of the lead wire 1311 may further be electrically connected to the conductive module 139 via the supporting assembly 1353.

The coil support 133 is configured for supporting the coil 131, and transferring motion of the coil 131 to the membrane module 135. The coil support 133 includes a main body 1331 which may be a rectangular ring-shaped plate for fixing the coil 131, a first extending part 1333 extending perpendicularly from an edge of the main body 1331, and a second extending part 1335 extending perpendicularly from an opposite edge of the main body 1331. The first extending part 1333 and the second extending part 1335 are parallel to each other, and each of the first extending part 1333 and the second extending part 1335 may be an elongated piece extending from the entire edge of the main body 1331.

Moreover, the main body 1331, the first extending part 1333 and the second extending part 1335 may be integrated into a one-piece structure to enhance an intensity of the coil support 133 and protect the coil 131 thereon from suffering undesired distortion. The first extending part 1333 and the second extending part 1335 may abut against the membrane 1351 and the supporting assembly 1353 respectively, and the second extending part 1335 includes a plurality of first through holes 13351 facing the supporting assembly 1353.

Furthermore, the coil support 133 may be made of material with light and rigid characteristics; for example, the coil support 133 may be made of aluminum alloy, which can improve an electro-acoustic converting efficiency of the speaker 1 as well as a rigidity of the coil support 133 to ensure stability of the coil 131. In other embodiments, the material of the coil support may alternatively be any one selected from magnesium alloy, stainless steel, plastic, and carbon fiber composite.

The membrane 1351 includes a first flat part 13513 located at a main central region thereof, and a first wrinkling part 13511 surrounding the first flat part 13513. The first wrinkling part 15311 has a wavy cross section, which enables the membrane 1351 to obtain great vibrating amplitude. The first extending part 1333 of the coil support 133 abuts against the first flat part 13513, and is located at a different side of the first flat part 13513 from the front dome 1371.

The supporting assembly 1353 may have a configuration similar to that of the membrane 135; the supporting assembly 1353 may be arranged at a different side of the coil support 133 from the membrane 1351, and be substantially symmetrical with the membrane 1351 about the coil support 133. The supporting assembly 1353 includes a second flat part 13533 located at a main central region thereof, and a second wrinkling part 13531 surrounding the second flat part 13533. The second extending part 1335 of the coil support 133 abuts against the second flat part 13533, and is located at a different side of the second flat part 13533 from the rear dome 1373.

The first extending part 1333 can expand a contact area between the coil support 133 and the membrane 1351, and the second extending part 1335 can expand a contact area between the coil support 133 and the supporting assembly 1353. As such, rigidity of the membrane 1351 and the supporting assembly 1353 can be improved.

Furthermore, the supporting assembly 1353 may further include a plurality of air holes 13535 formed at the second flat part 13533; the plurality of air holes 13535 may be arranged in a line and aligned with the first through holes 13351 of the coil support 133. The air holes 13535 may be communicated with the receiving cavity of the main frame 152 via the first through holes 13351.

The front dome 1371 and the rear dome 1373 are respectively attached on the first flat part 13513 of the first membrane 1351 and the second flat part 13533 of the supporting assembly 1353, and can further enhance the rigidity of the membrane 1351 and the supporting assembly 1353 and improve the sound effect of the speaker 1. The front dome 1371 may has a size and a shape corresponding to the first flat part 13513 of the membrane 1351; the rear dome 1373 is smaller than the second flat part 13533 of the supporting assembly 1353. In particular, the rear dome 1373 may includes a dome body 13733 located on a middle portion of the second flat part 13533, and at least one second through hole 13735 aligned with at least one air hole 13535 at the middle portion of the second flat part 13533.

The conductive module 139 includes a pair of flexible connecting members 1391 and a pair of conductive pads 13731. The pair of conductive pads 13731 is respectively arranged on the second flat part 13533 of the supporting assembly 1353 and at two opposite sides of the dome body 13733 of the rear dome 1373. Each of the flexible connecting members 1391 is connected between a corresponding one of the conductive pad 13731 and a receiving end 1374; in the present embodiment, each of the flexible connecting members 1391 may be a conductive spring such as a metal spring. In an alternative embodiment, as illustrated in FIG.

5, the flexible connecting members 1391 of the conductive module 139 may replaced by a pair of conductive wires 1391.

Each receiving end 1374 may be arranged at a third through hole 1571 formed in the rear cover 157 of the shell 15, and is further connected to the external circuit for receiving an electric signal. Furthermore, the pair of conductive pads 13731 may be aligned with two air holes 13535 in the supporting assembly 1353, and the free ends of the two lead wires 1331 of the coil 131 can pass through the first through holes 13351 of the coil support 133 and the aforesaid two air holes 13535, and then reaches and electrically fixed to the conductive pads 13731. Accordingly, the electric signal received by the connecting end 1374 can be transmitted to the coil 131 via the two conductive pads 13731, such that the coil 131 is enabled to drive the membrane 1351 to vibrate and produce audible sound.

In the speaker 1 as provided in the present disclosure, the lead wires 1311 of the coil 131 is connected to the conductive pads 13731 arranged on the supporting assembly 1353, because the supporting assembly 1353 is connected to the coil support 133, when the coil 133 drives the membrane 1351 to vibrate, the supporting assembly 1351 and the lead wires 1311 are capable of vibrating accompanying with the membrane 1351. Accordingly, the lead wires 1311 of the coil 131 would not retard the vibration of the membrane 1351, and the undesired shaking of the membrane 1351 can be depressed. Therefore, an acoustic performance of the speaker 1 can be ensured, and a reliability of the speaker 1 can also be improved.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a shell having a main frame with two opposite openings, a front cover and a rear cover covering the corresponding to opening, respectively;

a magnetic system received in the shell and having a first magnet module and a second magnet module opposite to and apart from the first magnet module for forming a magnetic gap; and a vibrating system having a coil support, a coil with two lead wires in shaped of an oblate ring mounted on the coil support for forming a coil assembly, a membrane module supported by one end of the coil support, and a supporting assembly supported by the other end of the coil support, the periphery of the membrane module and the supporting assembly respectively fixed on the main frame;

the coil assembly received in the magnetic gap of the magnetic system for driving the vibrating system and arranged in a plane perpendicular to the membrane module;

wherein the vibrating system further comprises a pair of conductive modules arranged on the supporting assembly far away from the coil assembly, each of the pair of conductive module having a conductive pad arranged on the supporting assembly, a receiving end arranged on the rear cover and a flexible connecting member connected between the conductive pad and the receiving end;

the two lead wires of the coil are fixed corresponding to the conductive pads through the conductive modules for electrically connecting external circuit, respectively.

2. The speaker of claim 1, wherein each of the flexible connecting members is a metal spring.

3. The speaker of claim 1, wherein each of the flexible connecting members is a conductive wire.

4. The speaker of claim 1, wherein the coil support comprises a main body for supporting the coil, and a first extending part and a second extending part perpendicularly extending from two opposite ends of the main body.

5. The speaker of claim 4, wherein the membrane comprises a first flat part and a wrinkling part surrounding the flat part, the supporting assembly has a membrane configuration comprising a second flat part and a second wrinkling part surrounding the second flat part; the first extending part and the second extending part of the coil support abut against the first flat part and the second flat part respectively.

6. The speaker of claim 5, wherein the second flat part of the supporting assembly comprises a plurality of air holes, the pair of conductive pads is formed on the second flat part and aligned with two of the air holes respectively.

7. The speaker of claim 6, wherein the second extending part of the coil support comprises a plurality of first through holes corresponding to the air holes of the supporting assembly; the pair of lead wires of the coil passes through two corresponding first through holes of the coil support and the two air holes of the supporting assembly, and is electrically fixed to the pair of conductive pads respectively.

8. The speaker of claim 6, wherein the vibrating system further comprises a first dome attached on the first flat part of the membrane, and a second dome attached on a middle portion of the second flat part of the supporting assembly, the pair of conductive pads are arranged at two opposite sides of the second dome.

9. The speaker of claim 8, wherein the second dome further comprises at least one second through hole aligned with at least one air hole at the middle portion of the second flat part.

10. The speaker of claim 1, wherein each of the first magnet module and the second magnet module further comprise two main magnets parallel to each other and a secondary magnet located between the two main magnets; the two main magnets of the first magnet module are respectively parallel to the main magnets of the second magnet module.

11. The speaker of claim 10, wherein the front cover and the rear cover are engaged with the main frame for covering two opposite openings, respectively.

12. The speaker of claim 11, wherein the front cover comprises a sound outlet for outputting audible sound, and the rear cover comprises a pair of third through holes, the receiving end is arranged at a corresponding one of the third through holes, and is further connected to an external circuit for receiving the electric signal.

13. The speaker of claim 12, wherein the main frame further comprises a top opening and a bottom opening, and the shell further comprises a top cover plate and a bottom cover plate for covering the top opening and the bottom opening respectively.

14. The speaker of claim 13, wherein the top cover plate and the bottom cover plate are detachable from the main frame.

* * * * *